US007397445B2

(12) United States Patent
Baek

(10) Patent No.: US 7,397,445 B2
(45) Date of Patent: Jul. 8, 2008

(54) METHOD OF DISPLAYING GRAY SCALE IN PLASMA DISPLAY PANEL

(75) Inventor: Seung Chan Baek, Seoul (KR)

(73) Assignee: LG Electronics Inc., Seoul (KR)

( * ) Notice: Subject to any disclaimer, the term of this patent is extended or adjusted under 35 U.S.C. 154(b) by 736 days.

(21) Appl. No.: 11/022,806

(22) Filed: Dec. 28, 2004

(65) Prior Publication Data

US 2005/0156825 A1 Jul. 21, 2005

(30) Foreign Application Priority Data

Dec. 31, 2003 (KR) ..... 10-2003-0102316

(51) Int. Cl.
*G09G 3/28* (2006.01)

(52) U.S. Cl. ..... 345/60; 345/63

(58) Field of Classification Search ..... 345/37, 345/41, 60–68, 690; 315/169.4
See application file for complete search history.

(56) References Cited

U.S. PATENT DOCUMENTS

| | | | | |
|---|---|---|---|---|
| 6,456,302 | B2 * | 9/2002 | Kawahara et al. | 345/693 |
| 6,476,824 | B1 * | 11/2002 | Suzuki et al. | 345/690 |
| 6,965,389 | B1 * | 11/2005 | Masuji et al. | 345/690 |
| 7,071,902 | B1 * | 7/2006 | Kawahara | 345/63 |
| 7,126,563 | B2 * | 10/2006 | Lin et al. | 345/63 |
| 2002/0190927 | A1 * | 12/2002 | Shoji et al. | 345/60 |
| 2003/0048242 | A1 * | 3/2003 | Jeong et al. | 345/63 |
| 2003/0193451 | A1 * | 10/2003 | Kimura | 345/60 |

FOREIGN PATENT DOCUMENTS

| | | |
|---|---|---|
| EP | 0 656 616 A1 | 12/1994 |
| EP | 0 947 975 A1 | 10/1999 |
| EP | 1 083 539 A2 | 3/2001 |

OTHER PUBLICATIONS

European Search Report dated Jul. 24, 2006.

* cited by examiner

*Primary Examiner*—Richard A. Hjerpe
*Assistant Examiner*—Mansour M Said
(74) *Attorney, Agent, or Firm*—Ked & Associates, LLP

(57) ABSTRACT

The present invention relates to a plasma display panel, and more particularly, to a method of displaying the gray scale in a plasma display panel. According to the present invention, a method of displaying gray scales in a plasma display panel having an inverse gamma correction unit that operates using gamma tables includes the steps of allowing the inverse gamma correction unit to match picture signals, which corresponds to an n number of frames (n is a natural number) respectively, to an n number of previously stored gamma tables, allowing the inverse gamma correction unit to perform an inverse gamma process on the picture signals received according to the matched gamma tables to produce real gray scales every frame, and allowing the inverse gamma correction unit to divide the real gray scales every frame by n and then to produce last real gray scales. More fine gray scales can be represented by extending the number of real gray scales. It is thus possible to remove noise and provide a much smooth image.

7 Claims, 4 Drawing Sheets

Fig. 3

| Last real gray scale | First gamma table (first frame) | Second gamma table (second frame) | Third gamma table (third frame) | Fourth gamma table (fourth frame) | Fifth gamma table (fifth frame) |
|---|---|---|---|---|---|
| 1 | 1 | 1 | 1 | 2 1 | 1 1 |
| $\frac{6}{5}$ | 1 | 4 1 | 3 1 | 1 | 2 |
| $\frac{7}{5}$ | 5 1 | 1 | 1 | 2 | 2 |
| $\frac{8}{5}$ | 1 | 1 | 2 | 2 | 5 2 |
| $\frac{9}{5}$ | 1 | 2 | 2 | 5 2 | 2 |
| 2 | 2 | 2 | 5 2 | 2 | 2 |
| $\frac{11}{5}$ | 2 | 5 2 | 2 | 2 | 3 |
| $\frac{12}{5}$ | 5 2 | 2 | 2 | 3 | 3 |
| $\frac{13}{5}$ | 2 | 2 | 3 | 3 | 5 3 |
| $\frac{14}{5}$ | 2 | 3 | 3 | 5 3 | 3 |
| 3 | 3 | 3 | 5 3 | 3 | 3 |
| $\frac{16}{5}$ | 3 | 5 3 | 3 | 3 | 4 |
| $\frac{17}{5}$ | 5 3 | 3 | 3 | 4 | 4 |
| $\frac{18}{5}$ | 3 | 3 | 4 | 4 4 | 5 4 |
| $\frac{19}{5}$ | 3 | 2 4 | 3 4 | 4 | 4 |
| 4 | 1 4 | 4 | 4 | 4 | 4 |

METHOD OF DISPLAYING GRAY SCALE IN PLASMA DISPLAY PANEL

This Nonprovisional application claims priority under 35 U.S.C. § 119(a) on patent application Ser. No. 10-2003-0102316 filed in Korea on Dec. 31, 2003, the entire contents of which are hereby incorporated by reference.

BACKGROUND OF THE INVENTION

1. Field of the Invention

The present invention relates to a plasma display panel, and more particularly, to a method of displaying the gray scale in a plasma display panel.

2. Description of the Background Art

In a plasma display panel, gray scales are displayed through a combination of sub-fields. For example, if eight sub-fields are employed, 256 gray scales can be displayed.

In order to remove pseudo contour noise generated when a motion image is displayed, however, gray scales where the pseudo contour noise is generated are excluded. Thus, the number of gray scales, which is much smaller than 256 gray scales, is used.

If usually 10 to 12 sub-fields are used for a selective write method, usually 50 to 150 numbers of gray scales are used. In this time, if a selective gray scale algorithm such as Gravity Center Code (GCC) is used, the number of gray scales is reduced below a half.

In consideration of this, a dithering process or an error diffusion process is used so as to supplement scant gray scales. Although scant gray scales can be supplemented through this process, the number of gray scales that can be supplemented has a limit.

A reduction in the number of gray scales adversely affect Average Picture Level (APL) such as a dark screen.

SUMMARY OF THE INVENTION

Accordingly, the present invention has been made in view of the above problems occurring in the prior art, and it is an object of the present invention to provide a method of displaying gray scales in a plasma display panel in which the number of the gray scales can be increased.

To achieve the above object, according to the present invention, there is provided a method of displaying gray scales in a plasma display panel having an inverse gamma correction unit that operates using gamma tables, including the steps of: allowing the inverse gamma correction unit to match picture signals, which corresponds to an n number of frames (n is a natural number) respectively, to an n number of previously stored gamma tables, allowing the inverse gamma correction unit to perform an inverse gamma process on the picture signals received according to the matched gamma tables to produce real gray scales every frame, and allowing the inverse gamma correction unit to divide the real gray scales every frame by n and then to produce last real gray scales.

According to the present invention, brightness, efficiency and the contrast ratio are improved and high-speed driving is accomplished.

BRIEF DESCRIPTION OF THE DRAWINGS

Further objects and advantages of the invention can be more fully understood from the following detailed description taken in conjunction with the accompanying drawings in which:

FIG. 3 is a view for explaining an exemplary operation of the inverse gamma correction unit according to an embodiment of the present invention.

DETAILED DESCRIPTION OF PREFERRED EMBODIMENTS

Preferred embodiments of the present invention will be described in a more detailed manner with reference to the drawings.

According to the present invention, there is provided a method of displaying gray scales in a plasma display panel having an inverse gamma correction unit that operates using gamma tables, including the steps of: allowing the inverse gamma correction unit to match picture signals, which corresponds to an n number of frames (n is a natural number) respectively, to an n number of previously stored gamma tables, allowing the inverse gamma correction unit to perform an inverse gamma process on the picture signals received according to the matched gamma tables to produce real gray scales every frame, and allowing the inverse gamma correction unit to divide the real gray scales every frame by n and then to produce last real gray scales.

The step of producing the real gray scales comprises allowing the inverse gamma correction unit to output an n number of real gray scale values for a picture signal for a particular cell of the same location, which forms each of the frames.

The step of producing the last real gray scales comprises allowing the inverse gamma correction unit to add an n number of real gray scale values to picture signals for particular cells located at the same location, which forms each of the frames, and divide the added result by n to produce the last real gray scales.

In the n number of the gamma tables, in the first gamma table, the first real gray scale is n in number and the last real gray scale is 1 in number, and as the number of the gamma tables reduces one by one, the number of the first real gray scale reduces one by one and the last real gray scale increases one by one, and in the last gamma table, the first real gray scale is 1 in number, and the last real gray scale is n in number.

Between-a given last real gray scale m and a next final real gray scale m+1 among the last real gray scales is equally divided by n, thus producing n−1 number of new gray scales.

Figure 1:
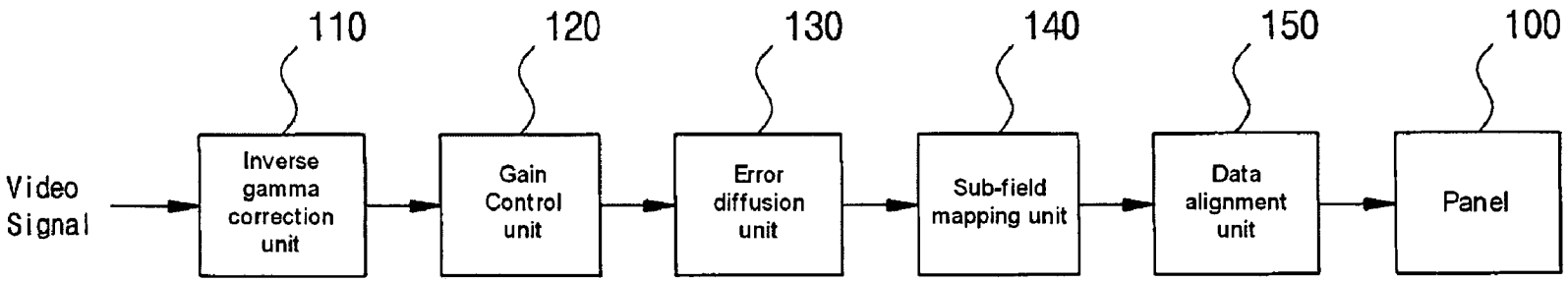
FIG. 1 is a block diagram illustrating the construction of an apparatus for increasing the number of gray scales according to an embodiment of the present invention.

FIG. 1 is a block diagram illustrating the construction of an apparatus for increasing the number of gray scales according to an embodiment of the present invention. Referring to FIG. 1, the apparatus for increasing the number of the gray scales according to the present invention includes an inverse gamma correction unit 110, a gain control unit 120, an error diffusion unit 130, a sub-field mapping unit 140 and a data alignment unit 150.

Inverse Gamma Correction Unit

The inverse gamma correction unit 110 performs an inverse gamma process on a received picture signal by matching picture signals corresponding to an n number of frames (n is a natural number) to an n number of previously stored gamma tables, and outputs real gray scales every frame. The inverse gamma correction unit 110 divides the real gray scales by n to produce last real gray scales.

Gain Control Unit

The gain control unit 120 adjusts gains by the R, G and B by multiplying R, G and B picture signals, which are corrected by the inverse gamma correction unit 110, by a value that can be controlled by a user or a set maker.

Error Diffusion Unit

The error diffusion unit 130 finely adjusts a brightness value by diffusing error components of data, which is from the gain control unit 120, into neighboring cells.

Sub-Field Mapping Unit

The sub-field mapping unit 140 maps data received from the error diffusion unit 130 to sub-field patterns that are previously set in the sub-field mapping unit 140.

Data Alignment Unit

The data alignment unit 150 realigns picture signals, which are mapped by the sub-field mapping unit, every sub-field, and then outputs the realigned picture signals to a panel 100.

The inverse gamma correction unit 110 according to the present invention will now be described in detail with reference to the drawings.

Figure 2:
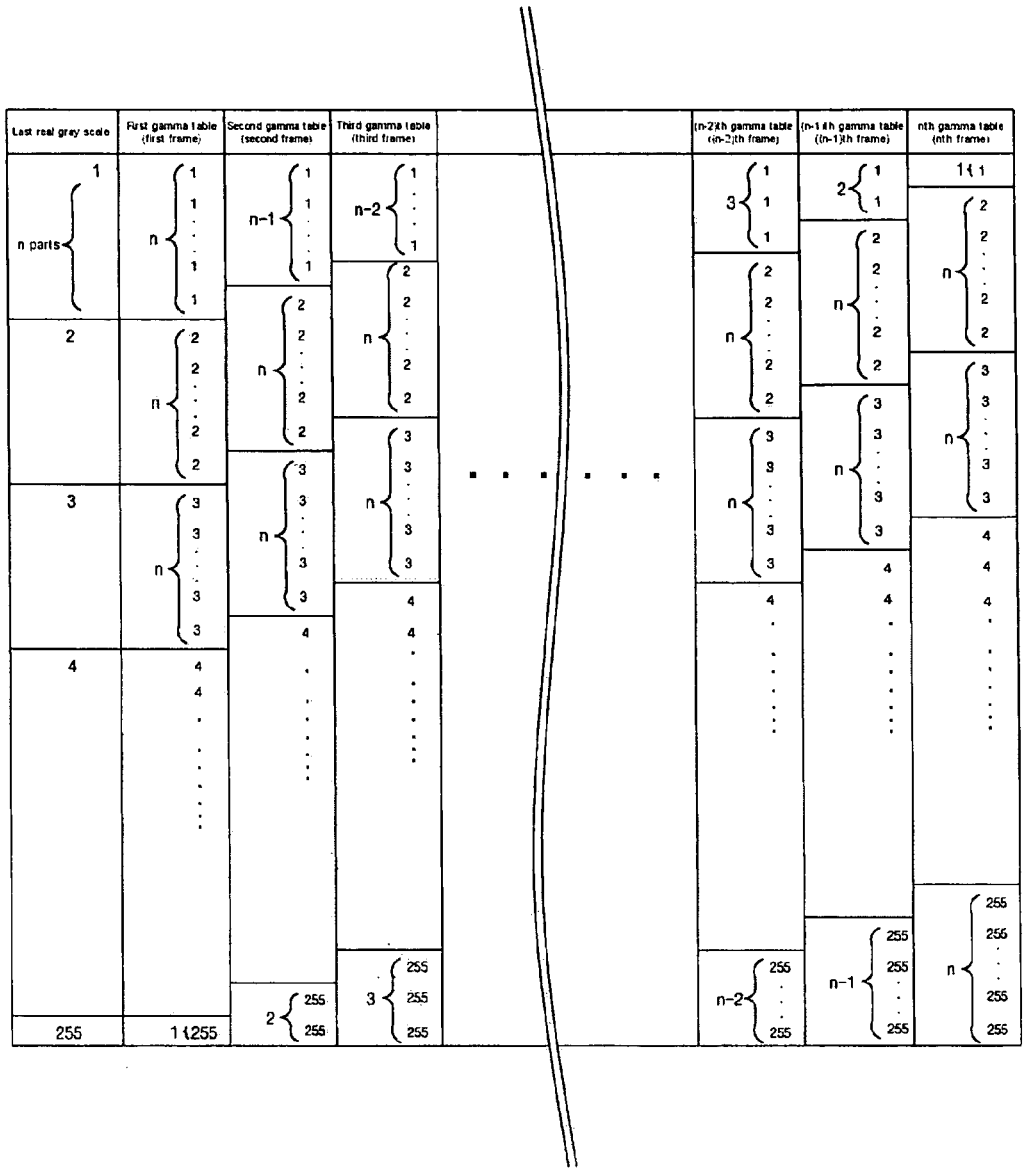
FIG. 2 is a view for explaining a process in which an inverse gamma correction unit outputs the last real gray scale through an n number of previously stored gamma tables according to an embodiment of the present invention.

FIG. 2 is a view for explaining a process in which an inverse gamma correction unit outputs the last real gray scale through an n number of previously stored gamma tables according to an embodiment of the present invention.

The plasma display panel 100 that operates at 60 Hz mode displays 60 frames per second on a screen. If a dither is used, a dither pattern is applied with variation, so that gray scales on the screen become smooth and noise is reduced.

If dithering or error diffusion is performed on each of real gray scales, the degree of the dithering or error diffusion used is determined by performing an inverse gamma correction process on the real gray scales before an image processing step.

In this time, the inverse gamma correction unit 110 outputs real gray scales of picture signals that are received through RGB channels, on which the inverse gamma correction process is performed, by using previously stored gamma tables.

The inverse gamma correction unit 110 according to the present invention sequentially matches an n number of frames to the n number of the gamma tables shown in FIG. 2, respectively, adds an n number of real gray scale values to picture signals for particular cells located at the same location, which constitute the respective frames, and then divides the added result by n to produce a last real gray scale.

In the n number of the gamma tables, which is used in the present invention, as shown in FIG. 2, a first gamma table is applied to a first frame. If a first gray scale 1 is n in number and a last gray scale 255 is 1 in number, the remaining gray scales are n in number.

A next second gamma table is applied to a second frame. If a first gray scale 1 is n−1 in number and a last gray scale 255 is 2 in number, the remaining gray scales are all n in number.

That is, in the first gamma table, a first real gray scale is n in number, and a last real gray scale is 1 in number. As the number of a gamma tables reduces one by one, the number of a first real gray scale reduces one by one, and a last real gray scale increases one by one. In a last gamma table, a first real gray scale is 1 in number, and a last real gray scale is n in number.

N number of real gray scale values is added to picture signals for particular cells located at the same location, which constitute the respective frames. The added result is divided by n to produce a last real gray scale. If the last real gray scale is outputted through this method, between a particular gray scale m and a next gray scale m+1 is divided by n, thus producing n−1 number of new gray scales.

FIG. 3 is a view for explaining an exemplary operation of the inverse gamma correction unit according to an embodiment of the present invention. As shown in FIG. 3, in order to represent last real gray scales, real gray scales of gamma tables are set to 1 to 4, and five gamma tables are used.

In the first gamma table, the first real gray scale 1 is 5 in number, and the last real gray scale 4 is 1 in number. The number of the gamma tables reduced one by one, the number of the first real gray scale 1 reduces one by one, and the number of the last real gray scale 4 increases one by one. In the last gamma table, the first real gray scale 1 is 1 in number, and the last real gray scale 4 is 5 in number.

5 number of real gray scale values is added to picture signals for particular cells located at the same location, which constitute the respective frames. The added result is divided by 5 to produce last real gray scales. If the last real gray scales are outputted through this method, between-a particular gray scale m and a next gray scale m+1 is divided by 5, thus newly producing 4 number of gray scales. For example, the last real gray scales of five equal parts, 6/5, 7/5, 8/5 and 9/5 exist between-the last real gray scales 1 and 2.

As described above, more fine gray scales can be represented by means of the operation of the inverse gamma correction unit 110 according to the present invention.

Figure 4:
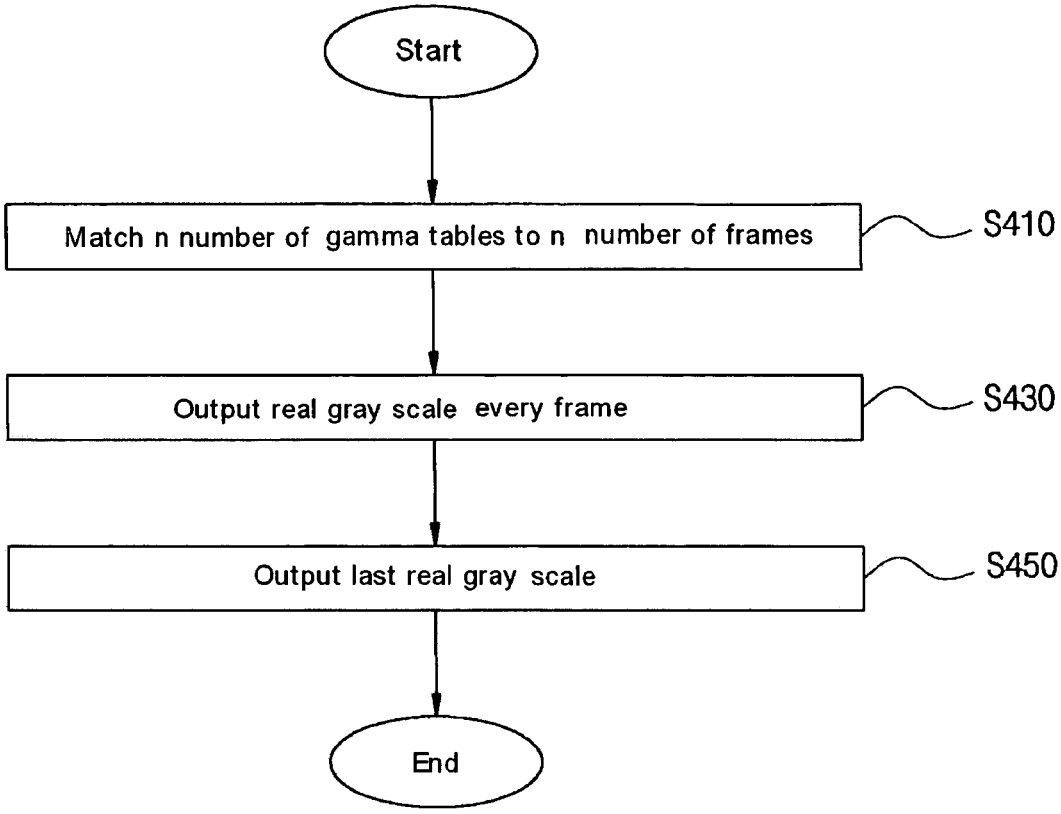
FIG. 4 is a flowchart illustrating process steps for embodying a method of displaying the gray scale according to an embodiment of the present invention.

FIG. 4 is a flowchart illustrating process steps for embodying a method of displaying the gray scale according to an embodiment of the present invention.

The inverse gamma correction unit 110 matches picture signals respectively corresponding to an n number of frames to an n number of previously stored gamma tables (S410).

The inverse gamma correction unit 110 performs an inverse gamma process on the picture signals, which are received according to the matched gamma tables, to output real gray scales every frame (S430).

In other words, the inverse gamma correction unit 110 sequentially matches the n number of the frames to the n number of the gamma tables, respectively, and outputs an n number of real gray scale values for a picture signal for a particular cell of the same location that forms each frame.

The inverse gamma correction unit 110 divides the real gray scales every frame by n to produce the last real gray scales (S450). That is, the inverse gamma correction unit 110 adds the n number of the real gray scale values to the picture signal for the particular cell of the same location that forms each frame, and then divides the added result by n to produce the last real gray scales.

In this time, since the n number of the gamma tables shown in FIG. 2 is employed, between-the last real gray scale m and the next final real gray scale m+1 is equally divided by n, thus newly producing the n−1 number of the gray scales.

According to the present invention as described above, more fine gray scales can be represented by extending the number of real gray scales. It is thus possible to remove noise and provide a much smooth image.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of displaying gray scales in a plasma display panel having an inverse gamma correction unit that operates using gamma tables, comprising the steps of:

(a) allowing the inverse gamma correction unit to match picture signals, which corresponds to an n number of frames (n is a natural number) respectively, to an n number of previously stored gamma tables;

(b) allowing the inverse gamma correction unit to perform an inverse gamma process on the picture signals received according to the matched gamma tables to produce real gray scales every frame; and (c) allowing the inverse gamma correction unit to divide the real gray scales every frame by n and then to produce last real gray scales.

2. The method as claimed in claim 1, wherein the step (b) of producing the real gray scales comprises allowing the inverse gamma correction unit to output an n number of real gray scale values for a picture signal for a particular cell of the same location, which forms each of the frames.

3. The method as claimed in claim 2, wherein the step (c) of producing the last real gray scales comprises allowing the inverse gamma correction unit to add an n number of real gray scale values to picture signals for particular cells located at the same location, which forms each of the frames, and divide the added result by n to produce the last real gray scales.

4. The method as claimed in claim 2, wherein in the n number of the gamma tables, in the first gamma table, the first real gray scale is n in number and the last real gray scale is 1 in number, and as the number of the gamma tables reduces one by one, the number of the first real gray scale reduces one by one and the last real gray scale increases one by one, and in the last gamma table, the first real gray scale is 1 in number, and the last real gray scale is n in number.

5. The method as claimed in claim 4, wherein between-a given last real gray scale m and a next final real gray scale m+1 among the last real gray scales is equally divided by n, thus producing n−1 number of new gray scales.

6. The method as claimed in claim 1, wherein the step (c) of producing the last real gray scales comprises allowing the inverse gamma correction unit to add an n number of real gray scale values to picture signals for particular cells located at the same location, which forms each of the frames, and divide the added result by n to produce the last real gray scales.

7. The method as claimed in claim 1, wherein between-a given last real gray scale m and a next final real gray scale m+1 among the last real gray scales is equally divided by n, thus producing n−1 number of new gray scales.

* * * * *